US006691936B2

(12) United States Patent
Yudanov

(10) Patent No.: US 6,691,936 B2
(45) Date of Patent: Feb. 17, 2004

(54) NEEDLE POSITION SENSING DEVICE

(75) Inventor: Sergi Yudanov, Vastra Frolunda (SE)

(73) Assignee: Volvo Lastvagnar AB, Göteborg (SE)

( * ) Notice: Subject to any disclaimer, the term of this patent is extended or adjusted under 35 U.S.C. 154(b) by 0 days.

(21) Appl. No.: 10/248,823

(22) Filed: Feb. 21, 2003

(65) Prior Publication Data

US 2003/0121994 A1 Jul. 3, 2003

Related U.S. Application Data

(63) Continuation of application No. PCT/SE00/01599, filed on Aug. 21, 2000.

(51) Int. Cl.[7] ..... F02M 61/20

(52) U.S. Cl. ..... 239/533.9; 239/533.9; 239/585.1; 239/600

(58) Field of Search ..... 239/88, 71, 73, 239/533.2, 533.3, 533.9, 533.11, 585.1, 600; 251/366, 367; 73/119 A; 285/144.1, 147.1, 149.1, 154.2

(56) References Cited

U.S. PATENT DOCUMENTS 4,340,181 A * 7/1982 Stumpp et al. ..... 239/533.3
4,398,670 A 8/1983 Hofmann
4,468,056 A * 8/1984 Kramer et al. ..... 285/147.1
4,490,576 A * 12/1984 Bolante et al. ..... 285/154.2
4,625,918 A 12/1986 Funada et al.
5,758,826 A * 6/1998 Nines ..... 239/136
6,062,499 A * 5/2000 Nakamura et al. ..... 239/585.1

FOREIGN PATENT DOCUMENTS

WO WO 94295891 A1 12/1994

* cited by examiner

*Primary Examiner*—Steven J. Ganey
(74) *Attorney, Agent, or Firm*—Howrey, Simon, Arnold & White LLP

(57) ABSTRACT

A fuel injector (1) including a first body and a second body, a capnut (9) which is in a threaded engagement with the first body and has a shoulder (10) for abutting against the second body to hold said first and second bodies together, a locating pin (7) for fixing the angular position of said first and second bodies relative to each other, a channel (14) arranged in the first and second bodies, a reciprocating needle (6) moveable within said first and second bodies for opening and closing the channel.

10 Claims, 3 Drawing Sheets

NEEDLE POSITION SENSING DEVICE

CROSS REFERENCE TO RELATED APPLICATIONS

This application is a continuation patent application of International Application No. PCT/SE00/01599 filed Aug. 21, 2000 which was published in English pursuant to Article 21(2) of the Patent Cooperation Treaty. Said applications is expressly incorporated herein by reference in its entirety.

BACKGROUND OF THE INVENTION

1. Field of the Invention

The present invention relates to means, methods and apparatus for sensing the position of the needle within the nozzle of a fuel injector for an internal combustion engine.

2. Background Information

It is possible to improve the efficiency of control of a fuel injection system by sensing whether the injecting nozzle is closed or open. This information can, for example, be used by the electronic control system of the engine to perform adaptive fueling or injection timing control.

Examples of apparatus for sensing the needle position within the nozzle of a fuel injector are generally known, as shown in U.S. Pat. Nos. 4,625,918 and 4,398,670. In these apparatus, the needle is electrically insulated from the nozzle body and the rest of the injector during the open positions of the nozzle by means of an insulating layer placed on the needle's guiding surface, and it is electrically connected to the nozzle body and therefore to the ground during the closed state of the nozzle. A disadvantage of such apparatus is that they require an electric conductor to be passed through the upper body of the injector for connection of the needle to an external continuity-sensing device. In case of the upper body of the injector being of a complicated design or when the spring chamber of the needle is used to provide a pressure backed nozzle closure, it becomes difficult and non-feasible to accommodate the electrically insulated and hydraulically sealed conductor in the injector's upper body.

An injection timing sensor disclosed by Milton et al. in the "Development of a Tuneable Diesel Engine Injection System for Engine Calibration and Optimization", ARC Collaborative Research Project, Final Report, School of Mechanical and Manufacturing Engineering, The University of New South Wales, Sydney, Australia, July 1998 provides a possible solution to this problem by means of insulating the upper body of the injector and including a needle spring chamber, from the ground and the lower body of the injector, and having a nozzle body, in addition to using the insulated needle as described above. In this design, the whole upper body acts as the conductor for connection of the needle to the continuity-sensing device, and therefore the need to pass a sealed and insulated electrical conductor through the upper body of the injector is eliminated.

To insulate the upper and the lower bodies of the injector from each other, an insulating layer similar to the one used for coating the needle may be used. It has to be applied to the thread of the cap nut holding the upper and lower bodies together, as well as to one of the surfaces forming a flat mechanical seal between the bodies. Usually, locating pins are used in the injectors to ensure a fixed angular position of one body of the injector relative to the other during assembly of the injector. Such pins protrude from one body and fit into the matching holes formed in the other body. Therefore, to achieve electrical insulation between the bodies, either the locating pins or the internal surface of the matching holes must be coated with the insulating layer.

In most cases, the diameters of the locating pins and the matching holes are not made exactly the same in order to facilitate easy assembly and reduce manufacturing costs. The relative position of the pins and the holes is also imperfect due to production tolerances. This means that when the locating pins prevent the relative rotation of the upper and lower bodies of the injector during the tightening of the cap nut, a line contact is formed between the pins and the matching holes. Moreover, as the internal surface of the holes is usually formed by drilling, it is difficult to achieve a very smooth surface, so that the contact surface between the pins and the holes might be reduced from the line to a point contact.

It is known that the forces acting on the locating pins due to the friction between the contact faces of the cap nut and the body opposite to the one that is engaged in threaded connection with the cap nut, may be so high that in some cases the pins are sheared apart. If a line or a point contact exists between the pin and the hole and there is an insulating layer on the pin, it is possible that the layer will be destroyed in that point of contact and the insulating barrier between the two injector bodies will be lost, resulting in the failure of the needle position sensor.

The purpose of the present invention is to overcome this problem and therefore increase the reliability of operation of the needle position sensing device.

SUMMARY OF THE INVENTION

In accordance with a first aspect of the present invention, there is provided a fuel injector incorporating a position register device, the fuel injector including a first body and a second body; a cap nut which is in a threaded engagement with the first body and has a shoulder for abutting against the second body to hold the first and second bodies together; locating pins for fixing the angular position of the first and second bodies relative to each other; the first and second bodies are electrically insulated from each other by means of an insulating layer; the insulating layer is deposited in such a way as to prevent the electrical contact between the locating pins and at least one of the bodies; an anti-friction layer between the shoulder and the second body; a reciprocating needle moveable within the first and the second bodies for opening and closing a nozzle; position register device electrically connected to the first body, and the second body and position register device each connected to a source of equal potential or ground, wherein the first and second bodies are not electrically connected when the needle is in an open position and wherein the first and second bodies are electrically connected when the needle is in the closed position.

In a second aspect the present invention is similar to that described above, but the layer, which is used to insulate injector the first and second bodies of the fuel from each other, possesses an anti-friction property and is therefore used between the shoulder and the second body instead of the anti-friction layer, wherein a connector is used to electrically connect the second body to the ground.

BRIEF DESCRIPTION OF THE DRAWINGS

The present invention will now be described by way of example with reference to the accompanying drawings, in which.

DETAILED DESCRIPTION

Figure 1:
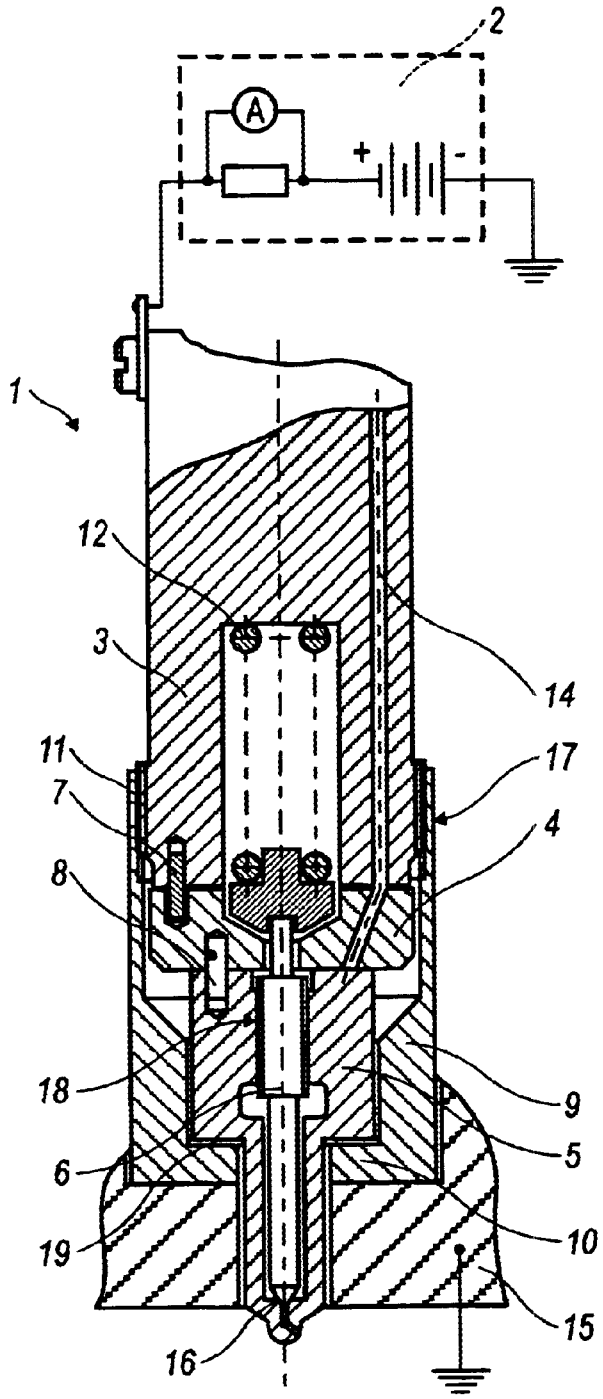
FIG. 1 is a longitudinal cross-sectional view of an exemplary embodiment of a fuel injector assembly constructed according to the teachings of the present invention.
Figure 2:
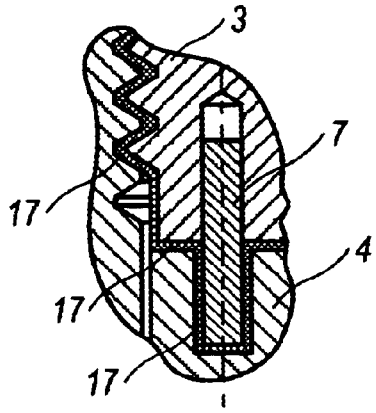
FIG. 2 is a detailed cross-sectional view of the locating pin and insulating layer.

The embodiment of FIG. 1 shows a fuel injector 1 and a position register device 2. The fuel injector consists of a first body including a spring chamber 3, second body having an adapter plate 4 and a nozzle 5, a needle 6, locating pins 7 and 8, cap nut 9 with a shoulder 10 and a thread 11, needle return spring 12 and a channel 14. Also shown is a fragment of an engine cylinder head 15 in which the fuel injector is installed. The spring chamber 3, the adapter plate 4 and the nozzle 5 are held together by the cap nut 9 which provides sufficient axial thrust to ensure that the high pressure fuel cannot escape out of the channel 14 anywhere but between the needle 6 and the needle seat 16 when the nozzle 5 is open. Locating pins 7 and 8 prevent the rotation of the nozzle 5, adapter plate 4 and the spring chamber 3 relative to each other during the tightening of the cap nut 9. The first and second bodies are electrically insulated from each other by means of an insulating layer 17. The pin 7 is also insulated from the second body by means of the insulating layer 17, as shown in FIG. 2. The second body is connected to the ground through the cap nut 9 and the engine cylinder head 15 as shown in FIG. 1. The cylindrical guiding surface 18 of the needle 6 is covered with an insulating layer that prevents the electrical contact between the needle and the nozzle 5 when the needle 6 is lifted away from the needle seat 16. The needle is electrically connected to the first body through the return spring 12. The first body is connected to the position register device 2 and is prevented from electrically contacting the ground anywhere but through the needle 6 and the needle seat 16 when the nozzle is closed.

An anti-friction layer 19 is provided between the shoulder 10 and the nozzle 5. The layer 19 reduces the torque transmitted to the locating pin 7 at a given axial thrust developed during the tightening of the cap nut 9. This reduces the force exerted by the pin 7 through the insulating layer 17 on the adapter plate 4. Thus, the possibility of an electrical contact between the first and second bodies of the injector because of destruction of the insulating layer 17 during assembly or operation of the injector is reduced.

Figure 3:
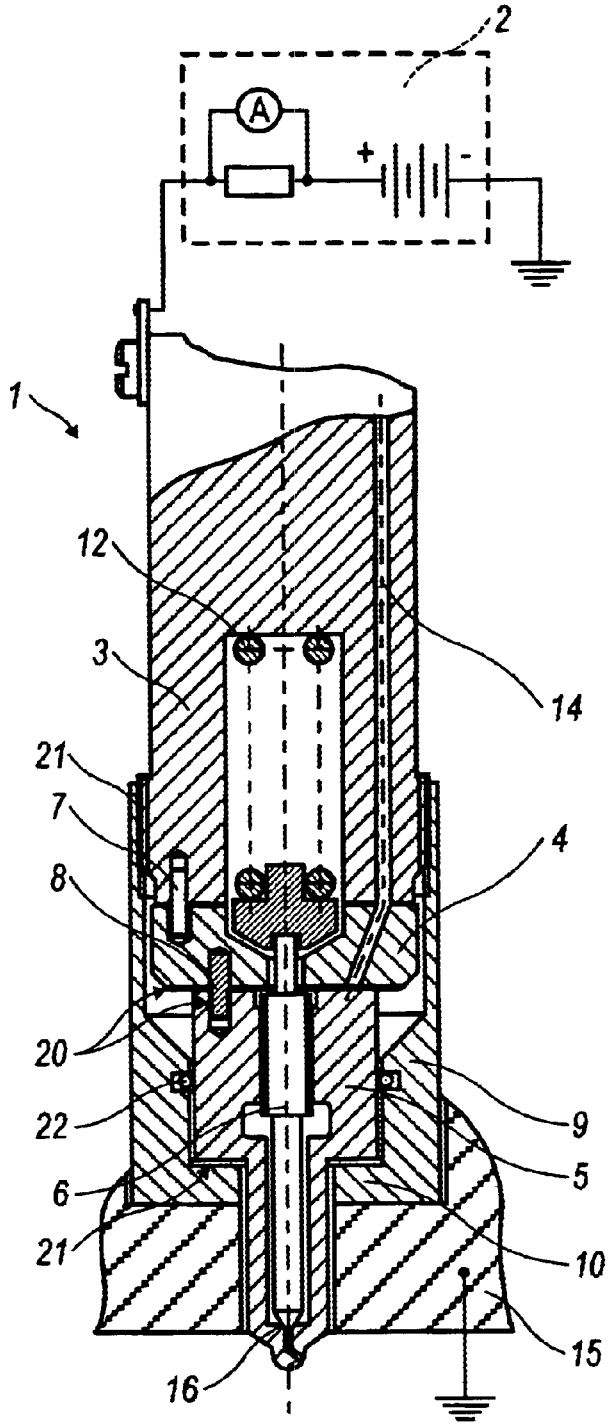
FIG. 3 is a longitudinal cross-sectional view of another exemplary embodiment of a fuel injector assembly constructed according to the teachings of the present invention.

An alternate form of the invention is shown in FIG. 3 which is similar to the one described above, but the first body in this case is included of the spring chamber 3 and the adapter plate 4, and the second body is included of the nozzle 5. Insulating layer 20 is placed between the adapter plate 4 and the nozzle 5, as well as between the locating pin 8 and the nozzle 5. In addition, the thread of the cap nut 9 is covered with an insulating layer 21 to prevent electrical contact between the first body and the ground through the capnut 9 and the engine cylinder head 15.

The insulating layer 20, 21 is such that it combines the electro-insulating and anti-friction properties. It can be, for example, a layer of a carbonized and ion-implanted substance or other suitable material. The use of such material makes it possible to apply it to the shoulder 10 of the cap nut 9 in lieu of the anti-friction layer for reduction of the torque transmitted to the locating pin 8. To maintain the electrical contact between the second body of the injector; in this case the nozzle 5, and the engine block 15 and ground, a connector 22 is positioned between the nozzle 5 and the capnut 9.

Figure 4:
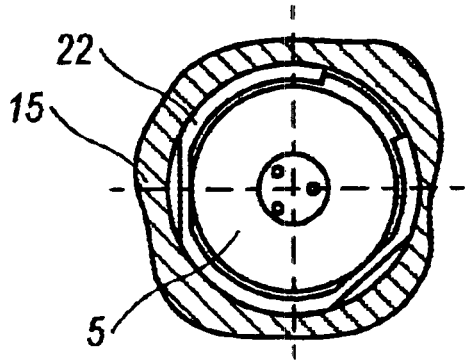
FIG. 4 is a detailed horizontal cross-sectional view of the nozzle.
Figure 5:
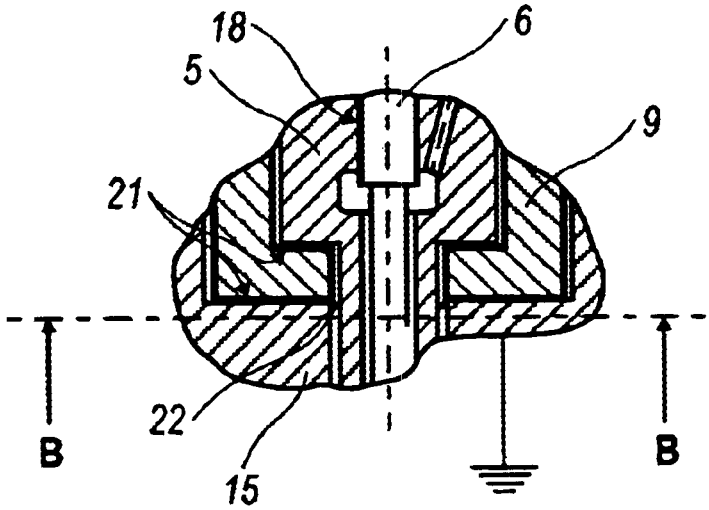
FIG. 5 is a detailed vertical cross-sectional view of the nozzle and needle.

Another alternate form of the invention is shown in FIG. 4 and which is similar to the one described above, but the electro-insulating and anti-friction layer 21 is deposited all over the cap nut, and the electrical contact between the second body (nozzle 5) and the ground is maintained by a connector 22 which connects the nozzle 5 to the engine cylinder head 15. Such connector can be made in the form of a circular spring clip, as shown in FIG. 4, or in the form of any other element that ensures a reliable electrical connection between the second body of the injector and the engine cylinder head.

The fuel injector and the position register device, according to the present invention, work as follows: Referring to FIG. 1, in the initial position the channel 14 is depressurized, the return spring 12 keeps the needle 6 in the bottom position as shown in FIG. 1, and the electric circuit between the position register device 2 and the engine cylinder head 15 is completed through the spring chamber 3, return spring 12, needle 6, needle seat 16,.nozzle 5; anti-friction layer 19 and the capnut 9.

When the high pressure fuel is supplied to the channel 14, it overcomes the force of the return spring 12 and lifts the needle 6 away from its seat 16. The instant the needle leaves the seat the injection of fuel starts, and at the same time the circuit between the position register device 2 and the engine cylinder head 15 becomes open because of the insulating layer 17 on the spring chamber 3 and the locating pin 7, which insulates the first body from the second body, and because of the insulating layer 18 between the needle 6 and the nozzle 5. When the injection is completed and the needle 6 closes the nozzle 5, the electrical contact between the position register device 2 and the engine cylinder head 15 is restored. The position register device provides an engine management system with the information on the instants of opening and closing of the nozzle, which can be used to monitor and control the injection timing and duration of injection process.

In the other form of the invention shown in FIG. 3, the fuel injector and the position register device work in the same way. When the nozzle is closed, the circuit between the position register device 2 and the engine cylinder head 15 is completed by the spring chamber 3, return spring 12, needle 6, needle seat 16, nozzle 5, connector 22 and the cap nut 9. The circuit is open when the needle opens the nozzle due to the insulating layer 18 being placed between the needle 6 and the nozzle S.

The form of the invention shown in FIG. 4 works in the same way; the only difference is that the electrical connection between the nozzle and the engine cylinder head is maintained via the connector 23 bypassing the capnut 9.

The advantages of the present invention over the known apparatus for sensing the position of the needle within the fuel injection nozzle are achieved by the following: (a) the application of the anti-friction layer 19 between the nozzle 5 and the shoulder 10 of the capnut 9; (b) the application of the layer which combines the electrically insulating and anti-friction properties both to insulate the first and second bodies of the injector and to provide the anti-friction layer between the nozzle 5 and the shoulder 10 of the capnut 9; and (c) the application of the capnut 9, the entire surface of which is covered with the electrically insulating and anti-friction layer, and the connector 23 for electrically connecting the nozzle 5 to the engine cylinder head 15.

The application of the anti-friction layer 19 between the nozzle 5 and the shoulder 10 of the cap nut 9 increases the reliability of the operation of the needle position sensor. This is because it reduces the torque transmitted to the locating pins 7 during the tightening of the cap nut. The reduced torque reduces the contact pressure between the pin and the matching hole thereby helping to prevent the damage of the insulating layer positioned between the pin and the hole. It is especially important as the contact area between the pin and the hole can be small due to manufacturing inaccuracies in the hole/pin position and diameters as explained above. In known systems, the absence of the anti-friction layer 19 will lead to excessive contact pressure on the locating pin surface which may destroy the insulating layer and cause the needle position sensor's failure.

The use of the anti-friction layer 19 to reduce the torque transmitted to the locating pins 7 has another advantage in that it reduces the strain in the first and second bodies of the injector resulting from the tightening of the capnut 9. This helps to keep the distortion of the precision guiding surfaces, which the first and/or second bodies may contain, to a minimum and therefore increase the reliability of the operation of the injector.

The application of the layer, which combines the electrically insulating and anti-friction properties, to both insulate the first and second bodies of the injector and provide the anti-friction layer between the nozzle 5 and the shoulder 10 of the cap nut 9, is advantageous in terms of reducing manufacturing costs, because it allows the use of the same technological process and equipment to incorporate the two different functional elements into the needle position sensing device. If the layer, which is used to insulate the first and second bodies anti-friction of the injector, does not possess the property, than a special anti-friction layer must be used to coat the shoulder of the cap nut 9, which adds cost. The use of a separate washer between the shoulder 10 and the nozzle 5 is possible, but should be avoided as it adds another dimension which must be included in the tolerance chain defining the relative position of the nozzle orifices and the combustion chamber of the engine. The use of a separate washer also increases the risk of a mistake during injector assembly, for instance, it can be forgotten to insert the washer, which will result in misalignment of the fuel jets in the combustion chamber and poor engine performance.

The application of the capnut 9, the entire surface of which is covered with the electrically insulating and anti-friction layer, together with the connector 23, as shown in FIG. 4, for electrically connecting the second body to the ground, may allow to further reduce the manufacturing cost by eliminating the operations necessary for masking or, alternatively, removing the insulating layer off the surfaces of the capnut 9 which are used to conduct electricity from the second body to the engine cylinder head as shown in FIG. 3.

It will be appreciated by persons skilled in the art that numerous variations and/or modifications may be made to the invention as shown in the specific embodiments without departing from the spirit or scope of the invention as broadly described. One such variation may be that the connector 23 is shaped as a leaf spring, or that this connector is not a separate element but a part of the second body or the cap nut specifically designed to provide the electrical contact between the embodiments second body and the ground. The present embodiments are, therefore, to be considered in all respects as illustrative and not restrictive.

What is claimed is:

1. A fuel injector comprising:

a first body and a second body;

a capnut that is in threaded engagement with the first body and has a shoulder for abutting against the second body to hold said first and second bodies together;

a locating pin for fixing the angular position of said first and second bodies relative to each other;

an insulating layer for electrically insulating said first body from said second body, said insulating layer being deposited in such a way that electrical contact is prevented between the locating pin and at least one of said bodies;

a channel arranged in the first and second bodies;

a reciprocating needle moveable within said first and second bodies for opening and closing the channel; wherein said first and second bodies are not electrically connected when said needle is in an open position and wherein said first and second bodies are electrically connected when the needle is in the closed position;

an anti-friction layer body is placed between said shoulder and said second body thereby reducing the torque transmitted to the locating pin when the cap nut is tightened.

2. The fuel injector as recited in claim 1, wherein a position register device which is connected to the first body, wherein said second body and said position register device are each connected to ground.

3. The fuel injector as recited in claim 1, wherein the anti-friction layer is deposited between the shoulder of the capnut and the second body by plating or coating methods.

4. A fuel injector comprising:

a first body and a second body;

a capnut in threaded engagement with the first body and having a shoulder for abutting against the second body to hold said first and second bodies together;

a locating pin for fixing the angular position of said first and second bodies relative to each other;

a channel arranged in the first and second bodies;

a reciprocating needle moveable within said first and second bodies for opening and closing the channel; and an anti-friction layer is placed between said shoulder and said second body, thereby reducing the torque transmitted to the locating pin when the capnut is tightened.

5. The fuel injector as recited in claim 4, wherein the anti-friction layer is deposited between the shoulder of the capnut and the second body by plating or coating methods.

6. A fuel injector comprising:

a first body and a second body;

a capnut engaged with the first body and having a shoulder for abutting against the second body to hold said first and second bodies together;

a locating pin for fixing the angular position of said first and second bodies relative to each other;

a channel arranged in the first and second bodies;

a reciprocating needle moveable within said first and second bodies for opening and closing the channel and said first and second bodies are not electrically connected when said needle is in an open position and are electrically connected when the needle is in the closed position; and an insulating layer positioned between said first body and said second body for electrically insulating said first body from said second body.

7. The fuel injector as recited in claim 6, further comprising an anti-friction layer body located between said shoulder and said second body thereby reducing the torque transmitted to the locating pin when the cap nut is tightened.

8. The fuel injector as recited in claim 7, wherein said anti-friction layer is deposited between said shoulder of said capnut and said second body by plating or coating methods.

9. The fuel injector as recited in claim 6, further comprising:

a connector for electrically connecting the second body to ground; and wherein the insulating layer that electrically insulates said first body from said second body has an anti-friction property.

10. The fuel injector as recited in claim 6, further comprising a position register device connected to said first body, and said second body and said position register device each being connected to ground.

* * * * *